US006092474A

United States Patent [19]

Chen

[11] Patent Number: 6,092,474

[45] Date of Patent: Jul. 25, 2000

[54] COMPUTER DESK WITH PNEUMATIC ELEVATION CONTROL MEANS

[76] Inventor: Chao Ken Chen, No.15-1, Fu-Kung Rd., Chung-Hua Hsien, Taiwan

[21] Appl. No.: 09/343,366

[22] Filed: Jun. 30, 1999

[30] Foreign Application Priority Data

Jul. 4, 1998 [TW] Taiwan ..... 87210766

[51] Int. Cl.[7] ..... A47B 9/00

[52] U.S. Cl. ..... 108/147; 108/147.19

[58] Field of Search ..... 108/147, 96, 95, 108/147.11, 147.19, 144.11, 106, 49; 248/413, 411, 404

[56] References Cited

U.S. PATENT DOCUMENTS

| | | | |
|---|---|---|---|
| 1,782,660 | 11/1930 | Meyer | 248/413 |
| 2,703,691 | 3/1955 | Minnis | 108/147.19 X |
| 4,163,536 | 8/1979 | Heller et al. | 248/413 X |
| 4,365,561 | 12/1982 | Tellier et al. | 108/96 X |
| 5,207,405 | 5/1993 | Cobb | 108/49 X |
| 5,243,921 | 9/1993 | Kruse et al. | 108/147 |
| 5,606,918 | 3/1997 | Cauffiel | 108/49 X |
| 5,615,620 | 4/1997 | Owen | 108/49 X |
| 5,767,079 | 2/1999 | Charny | 108/147 X |
| 5,845,587 | 12/1998 | Ditonto | 108/147 X |

*Primary Examiner*—Jose V. Chen

*Attorney, Agent, or Firm*—Pro-Techtor International Services

[57] ABSTRACT

A computer desk includes an upright square tube raised from a base, locating ring moved along the upright square tube, a sleeve moved up and down with the locating ring along the upright square tube and supported on a pneumatic cylinder inside the upright square tube, a first desk top fixedly supported on the sleeve, and a tightening up screw threaded into a transverse screw hole at the sleeve and fastened tight to stop the locating ring against the periphery of the upright square tube in fixing the locating ring and the sleeve to the upright square tube at the desired elevation.

3 Claims, 5 Drawing Sheets

COMPUTER DESK WITH PNEUMATIC ELEVATION CONTROL MEANS

BACKGROUND OF THE INVENTION

The present invention relates to computer desks, and more particularly to such a computer desk that uses a pneumatic cylinder and a sleeve on the pneumatic cylinder to support a desk top, and a tightening up screw to fix the sleeve at the desired elevation.

A variety of computer desks have been disclosed, and have appeared on the market. FIG. 1 shows a computer desk according to the prior art. This structure of computer desk comprises a base B shaped like an I-beam, a pneumatic cylinder A mounted on the base B on the middle, a desk top C supported on the pneumatic cylinder A and moved up and down with the piston rod of the pneumatic cylinder A to the desired elevation, and two upright guide tubes B1 and B2 bilaterally raised from the base B and inserted through a respective through hole at the desk top C to guide vertical movement of the desk top C. Because the piston rod of the pneumatic cylinder A is rotatable, the upright guide tubes B1 and B2 are necessary to prevent rotary motion of the desk top C upon reciprocating motion of the pneumatic cylinder A. If the piston rod of the pneumatic cylinder A is not rotatable, the upright guide tubes B1 and B2 can be eliminated.

SUMMARY OF THE INVENTION

According to one aspect of the present invention, the computer desk comprises an upright square tube raised from a base, locating ring moved along the upright square tube, a sleeve moved up and down with the locating ring along the upright square tube and supported on a pneumatic cylinder inside the upright square tube, a first desk top fixedly supported on the sleeve, and a tightening up screw threaded into a transverse screw hole at the sleeve and fastened tight to stop the locating ring against the periphery of the upright square tube in fixing the locating ring and the sleeve to the upright square tube at the desired elevation. According to another aspect of the present invention, a second desk top is fixedly connected to the first desk top by a horizontal connecting bar at a front side.

DETAILED DESCRIPTION OF THE PREFERRED EMBODIMENT

Figure 1:
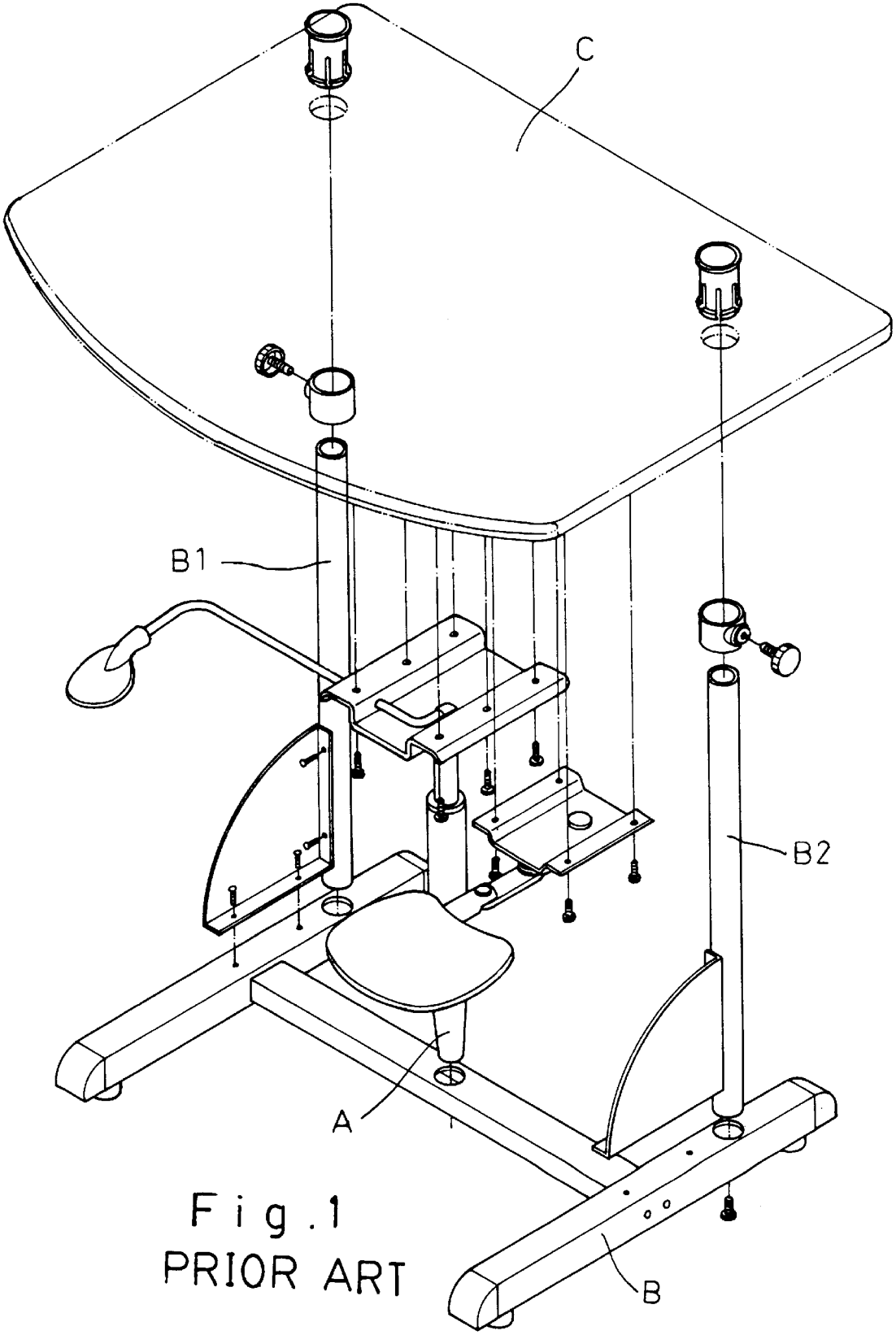
Fig.1 PRIOR ART
FIG. 1 is an exploded view of a computer desk according to the prior art.
Figure 2:
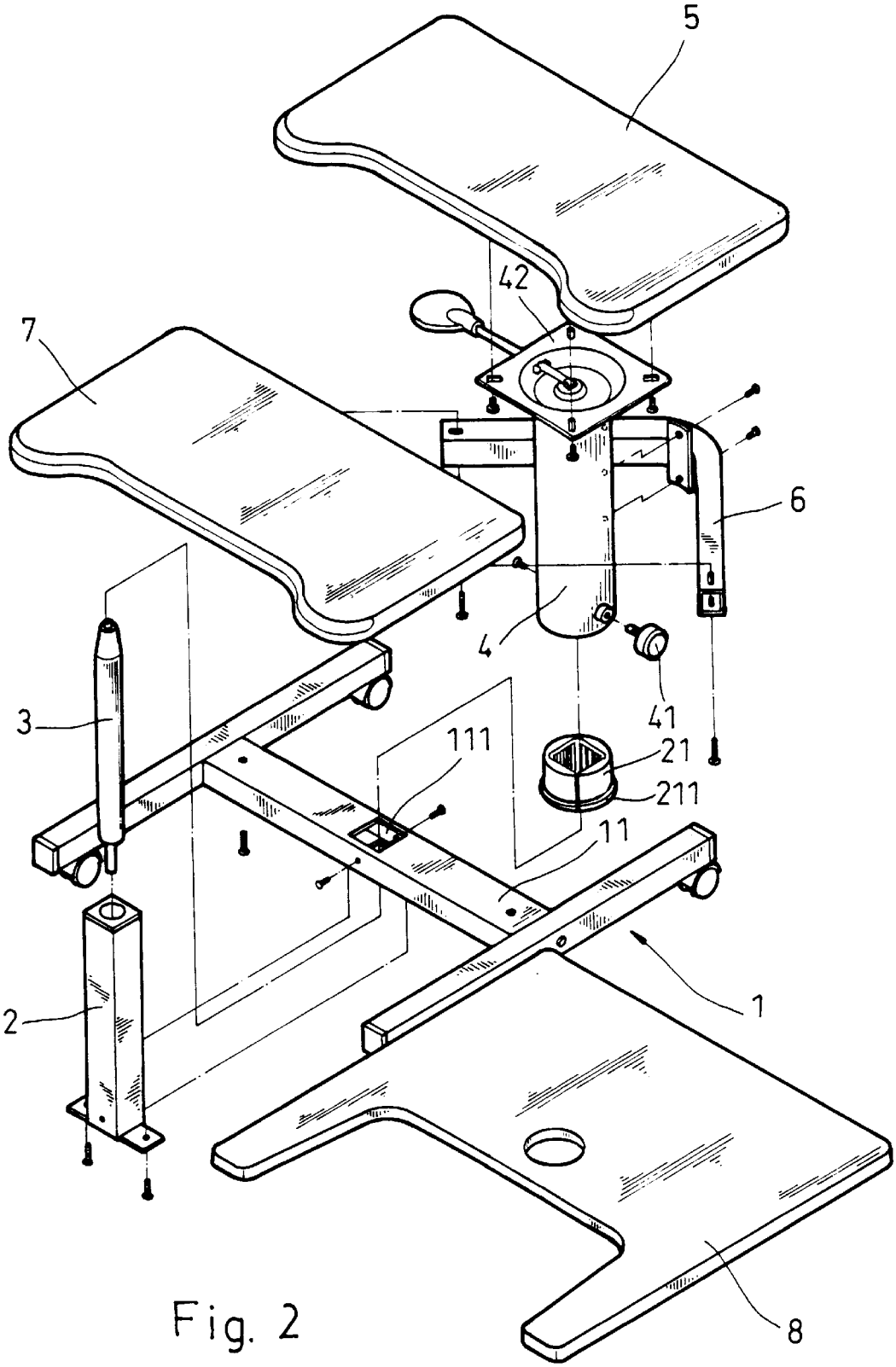
FIG. 2 is an exploded view of a computer desk according to the present invention.
Figure 3:
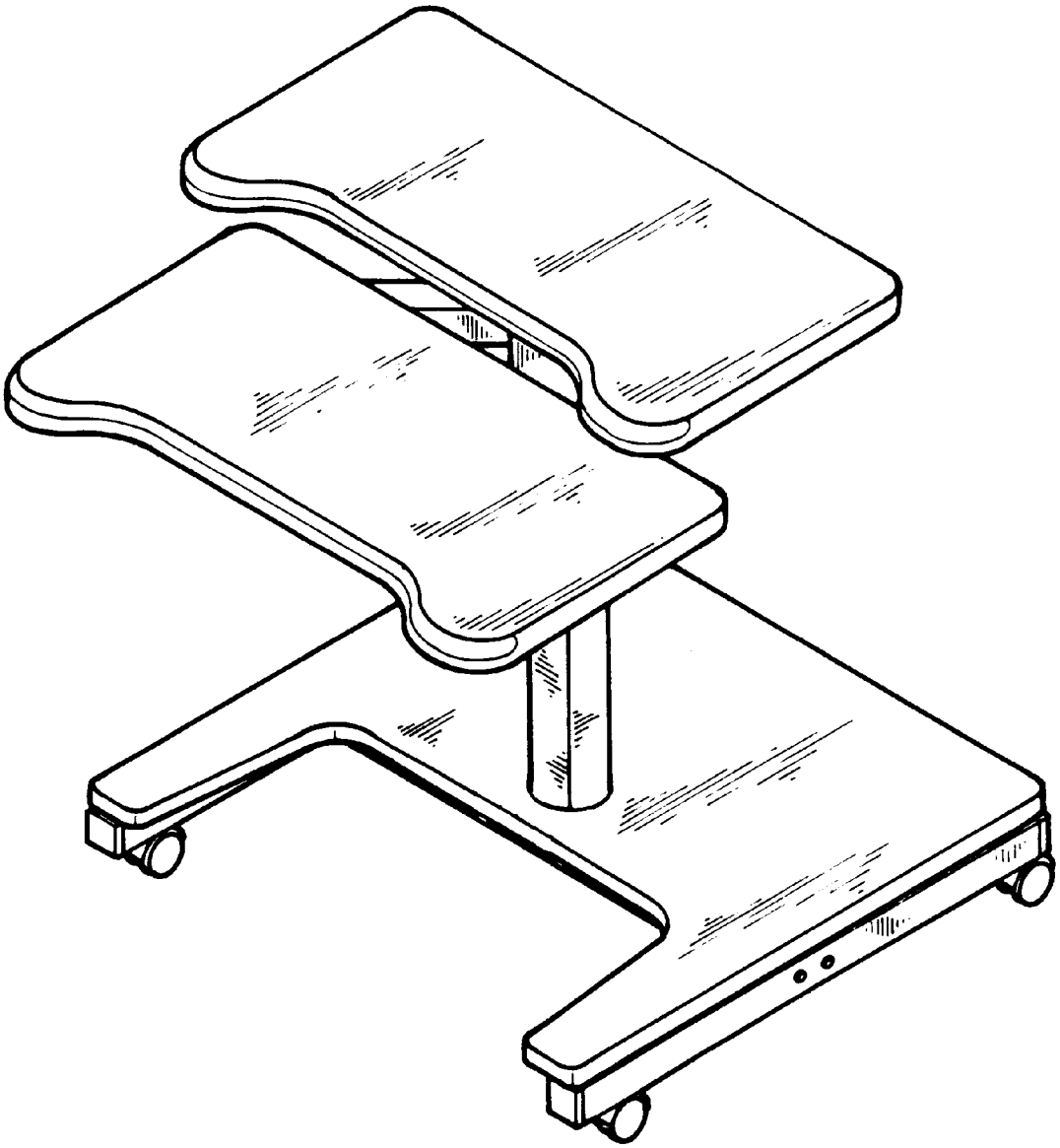
FIG. 3 is an assembly view of the computer desk shown in FIG. 2.

Referring to FIGS. 2 and 3, a computer desk in shown comprised of a base 1 shaped like an I-beam, an upright square tube 2 inserted through the square through hole 111 on the middle of the longitudinal bar 11 of the base 1 and fixedly secured to the base 1, a locating ring 21 mounted around the periphery of the upright square tube 2, the locating ring 21 having an outward flange 211 raised around the periphery at its bottom side, a sleeve 4 sleeved onto the upright square tube 2 and supported on the outward flange 211 of the locating ring 21 and fixedly connected to the locating ring 21 by screw means, the sleeve 4 having a top flange 42, a pneumatic cylinder 3 mounted in the upright square tube 2, the pneumatic cylinder 3 having a cylindrical casing vertically extended out of the upright square tube 2 and fixedly connected to the top end of the sleeve 4 and a piston rod downwardly extended out of the cylindrical casing and fixedly connected to the bottom end of the upright square tube 2, a tightening up screw 41 threaded into a transverse screw hole at the sleeve 4 and fastened tight to stop the locating ring 21 against the periphery of the upright square tube 2, causing the locating ring 21 to be fixed to the upright square tube 2 at the desired elevation, a first desk top 5 fixedly supported on the top flange 42 of the sleeve 4, a second desk top 7 fixedly connected to the first desk top 5 at a front side by a horizontal connecting bar 6, and a rack 8 mounted on the base 1 for holding a computer and/or computer peripheral apparatus.

Figure 4:
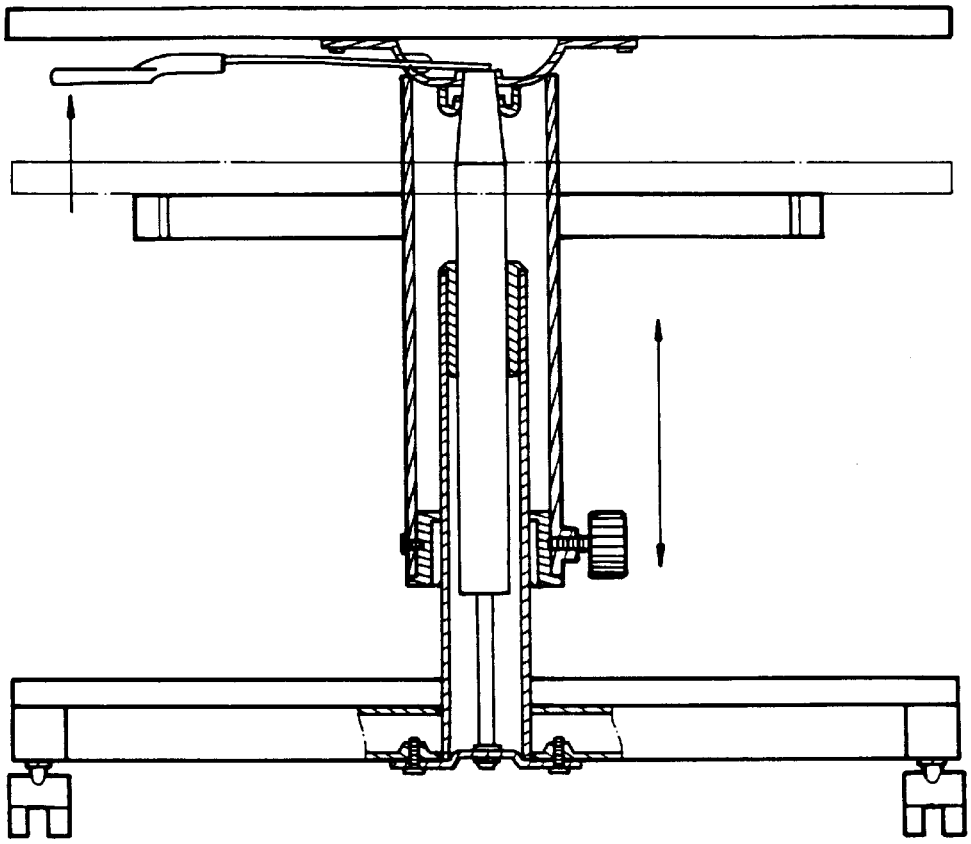
FIG. 4 is a side view in section of the present invention, showing the computer desk adjusted.
Figure 5:
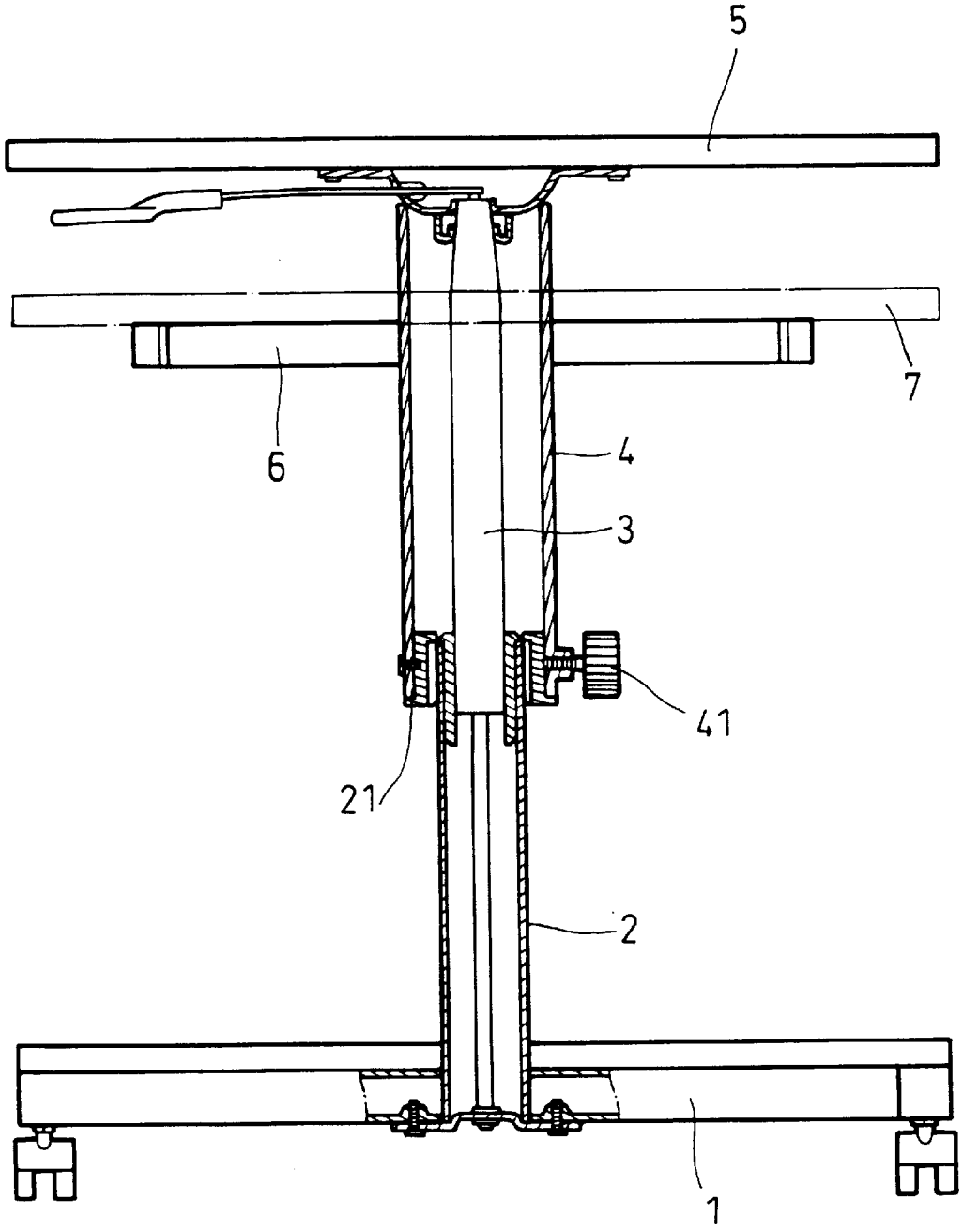
FIG. 5 is similar to FIG. 4 but showing the front table top and the rear table top adjusted to higher elevations.

Referring to FIGS. 4 and 5, when the tightening up screw 41 is loosened, the locating ring 21 is allowed to be moved with sleeve 4 along the upright square tube 2 to adjust the first desk top 5 to the desired elevation. When the first desk top 5 is moved vertically, the second desk top 7 is carried with the first desk top 5 up and down. When adjusted, the tightening up screw 41 is fastened tight again to fix the computer desk at the adjusted elevation.

What the invention claimed is:

1. A computer desk comprising:

a base;

an upright square tube having a bottom end fixedly fastened to said base on the middle;

a locating ring mounted on said upright square tube; a sleeve sleeved onto said upright square tube and moved up and down with said locating ring along said upright square tube, said sleeve having a top flange at a top end thereof and a transverse screw hole near a bottom end thereof;

a first desk top fixedly supported on the top flange of said sleeve;

a pneumatic cylinder mounted in said upright square tube, said pneumatic cylinder having a top end vertically extended out of said upright square tube and fixedly connected to the top end of said sleeve and a bottom end fixedly connected to the bottom end of said upright square tube; and a tightening up screw threaded into the transverse screw hole at said sleeve and fastened tight to stop said locating ring against the periphery of said upright square tube in fixing said locating ring and said sleeve to said unright square tube at the desired elevation; wherein a flange is raised around a lower periphery of said locating ring, said flange supporting said sleeve.

2. The computer desk of claim 1 further comprising a second desk top fixedly connected to said first desk top at a front side by a horizontal connecting bar.

3. The computer desk of claim 1 further comprising a rack mounted on said base for holding things.

* * * * *